United States Patent [19]

Robertson, Jr. et al.

[11] 4,450,700

[45] May 29, 1984

[54] METHOD AND APPARATUS FOR NECKING AND FLANGING CONTAINER BODIES

[75] Inventors: Field I. Robertson, Jr., Midlothian; George D. Bryan, Jr., Mechanicsville, both of Va.

[73] Assignee: Reynolds Metals Company, Richmond, Va.

[21] Appl. No.: 441,688

[22] Filed: Nov. 15, 1982

[51] Int. Cl.[3] ..... B21D 19/04

[52] U.S. Cl. ..... 72/115; 72/118

[58] Field of Search ..... 72/77, 78, 92, 115, 72/117, 123, 67, 68, 118, 119, 126

[56] References Cited

U.S. PATENT DOCUMENTS

| | | | |
|---|---|---|---|
| 457,909 | 8/1891 | Clapp . | |
| 766,633 | 8/1904 | Lovekin . | |
| 1,076,134 | 10/1913 | Manning | 153/124 |
| 1,322,921 | 11/1919 | Maupin . | |
| 1,419,929 | 6/1922 | Jackson . | |
| 1,421,507 | 7/1922 | Lindberg . | |
| 1,478,692 | 12/1923 | Baranoff . | |
| 3,266,451 | 8/1966 | Kraus | 113/120 |
| 3,354,680 | 11/1967 | Jacobsen | 72/126 |
| 3,494,162 | 2/1970 | Hansson | 72/126 |
| 3,831,416 | 8/1974 | Wolfe | 72/117 |
| 3,898,828 | 8/1975 | Cassai et al. | 72/117 |

FOREIGN PATENT DOCUMENTS 1534716 12/1978 United Kingdom .

*Primary Examiner*—Lowell A. Larson
*Attorney, Agent, or Firm*—Alan T. McDonald

[57] ABSTRACT

A method and apparatus for necking and flanging container bodies are disclosed. One or more free-wheeling dies are rotated within a stationary outer die and are journeled for radial movement within the outer die. The open edge portion of a metallic can body is positioned between the dies, with the action of the dies forming a neck on the can body. Subsequently, the necked end of the can body may be contacted with a flanging surface of the free-wheeling die or dies, forming a flange on the outer edge of the container body.

10 Claims, 7 Drawing Figures

1
3
5
7
9
10
12
13
14
15
16

METHOD AND APPARATUS FOR NECKING AND FLANGING CONTAINER BODIES

BACKGROUND OF THE INVENTION

Metallic cans for packaging of foods and beverages are staple articles of commerce.

Originally, such cans were formed of three separate pieces. A rectangular metallic sheet was rolled into a cyclinder, with the seam portion along its length being soldered or welded to a leak-proof state. The top and bottom edges of the cylindrical body were flanged to accept an end wall element at each end thereof. The end walls were sealed to the cylindrical body by means of the conventional double seaming operation.

More recently, three-piece container bodies have been increasingly replaced, especially in the beverage field, with two-piece drawn and ironed cans. In such a system, a circular blank of sheet material is drawn into a cup-like shape. Subsequently, the cup is redrawn to lengthen the side wall and reduce the diameter thereof. Next, the side wall is lengthened and thinned by ironing between a punch and die members. Finally, the closed bottom is forced against a bottom former, which shapes the bottom portion, adding strength to the container.

At first, these two-piece containers were flanged and given a single end wall in the same manner as the three-piece container. However, since both top and bottom end walls were not necessary, space savings in storage of filled containers and metal usage reduction could be realized by necking the open edge portion of the container body inwardly, prior to placing the end wall thereon, such that the end wall diameter did not exceed the side wall diameter of the container body. Such an inward necking of container bodies is now commonplace.

In a further attempt to reduce metal usage, it was next proposed to reduce further the diameter of the open container edge by means of a second necking operation. Thus, container bodies were necked at a first station, necked a second time at a second station and finally flanged. This operation proved successful in further reducing metal usage, without substantially adversely affecting the container.

Most recently, it was proposed to again reduce container opening diameters by yet another necking operation. Thus, triple necking of container bodies prior to flanging began. This, however, has not met with complete success.

While substantial reduction in metal usage from the container end wall structure resulted from triple necking, it was found that the edge portion of the container body was more prone to pin holes and cracks than previously. Thus, it was necessary to increase the wall thickness of the container body adjacent the opening thereof during the ironing of the container body to its final length, to provide additional metal for the added strength necessary to survive the three separate necking operations.

In the past, single, double, and triple necking have all been accomplished by means of a stationary die or dies positioned within the container body and an outer die which rotated around the outside of the container body, with necking occurring between these inner and outter die elements.

It is desirable, therefore, to produce a method and apparatus for necking and flanging container bodies which is capable of producing the reduced open end diameter of a triple-necked container, but which forms this neck with but a single shoulder.

It is also desirable to produce a method and apparatus for necking container bodies which may accomplish necking to triple-neck diameter in a single step.

It is further desirable to provide a method and apparatus for necking and flanging container bodies to reduce open end diameters without the need for a thickened edge portion on the container body, thus resulting in reduced metal usage in forming the container.

It is also desirable to provide a method and apparatus for necking and flanging container bodies which employs a stationary outer die member, thus providing for a more compact unit.

THE PRESENT INVENTION

By means of the present invention, these desired objectives are obtained.

The present invention comprises positioning the open edge portion of a container body between a pair of die elements. The die elements comprise a stationary outer die having an annular die surface with a surface profile corresponding to the desired configuration for the necked region of the container body and one or more inner dies which are free-wheeling to rotate about their axis and which are mounted for driven rotation against the inner surface of the edge portion of the container body and which have a surface profile corresponding to the desired configuration for the neck region of the container body. The inner die or dies are also mounted for radial movement with respect to the axis of the outer die, to enable the finished container body to be removed from the die set.

The inner die or dies may also include a flanging surface thereon, such that the necked container body may be moved against the flanging surface to form a flange thereon after necking.

BRIEF DESCRIPTION OF THE DRAWINGS

The method and apparatus of the present invention will be more fully described with reference to the drawings in which.

DETAILED DESCRIPTION OF THE PREFERRED EMBODIMENTS

Figure 1:
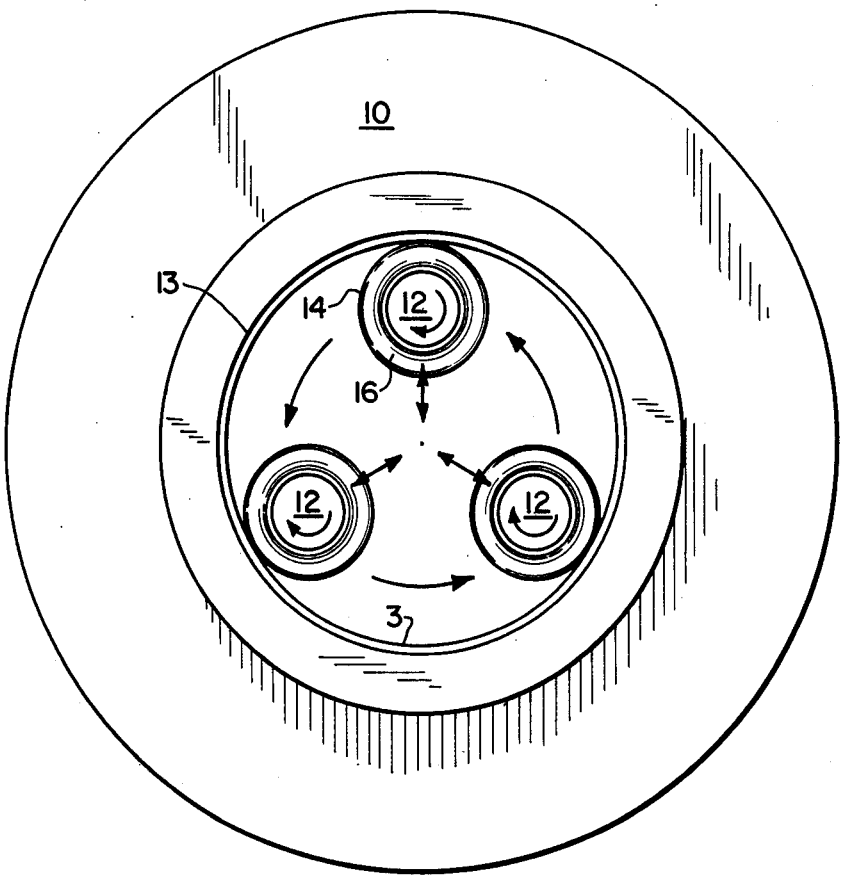
FIG. 1 is an end view of the die set employed in the present invention, illustrating the relative movements of the die members.

Turning now to the Figures, FIG. 1 illustrates the positioning and relative movement of the die members employed in the method and apparatus of the present invention. An outer stationary die 10 includes an annular working surface 13 against which the outer surface of the edge region 3 of a can body is worked. One or more (as illustrated in FIG. 1 three) inner die members 12 are mounted for rotation within die member 10. The dies 12 are free-wheeling about their axis and contact the inner surface of the edge region 3 of the can body 1. As such, the direction of rotation of the outer surface 14 of the inner die members 12 is opposite to that of the direction of rotation of the die members 12 within stationary die 10.

Additionally, the inner die members 12 are mounted for radial movement with respect to the axis of the outer stationary die 10 within stationary die 10. The necessity for such movement will be described below.

Figures 2, 3, 4, 5, 6, 7:
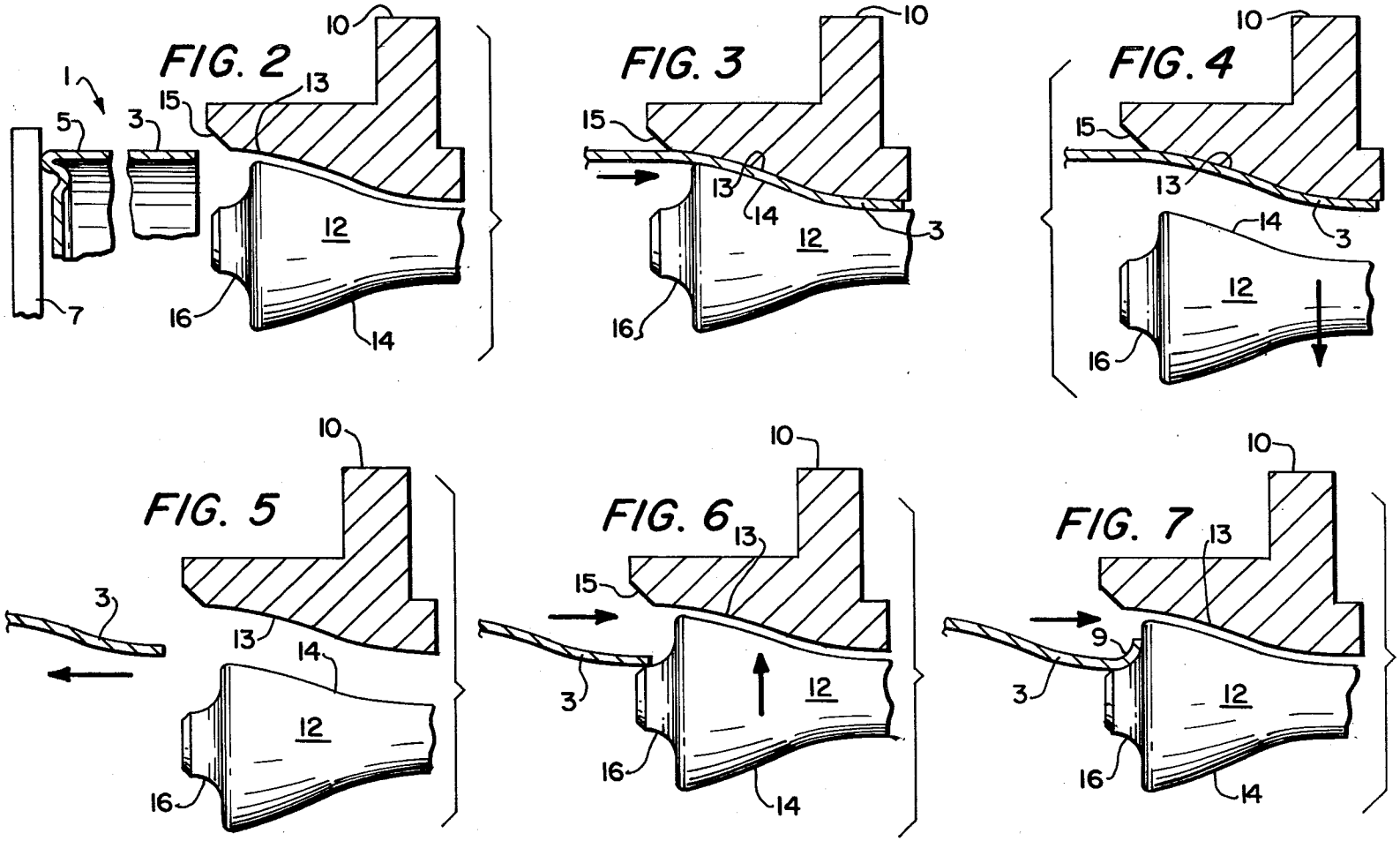
FIG. 2 is a partial cross-sectional view illustrating the positioning of the container body and die members prior to beginning the necking operation.
FIG. 3 is a partial cross-sectional view illustrating the positioning of the container body and the die members during the necking operation.
FIG. 4 is a partial cross-sectional view illustrating the positioning of the container body and the die members after completion of the necking operation.
FIG. 5 is a partial cross-sectional view illustrating the removal of the necked container body from the die members.
FIG. 6 is a partial cross-sectional view illustrating the positioning of the container body and the die members just prior to the flanging operation.
FIG. 7 is a partial cross-sectional view illustrating the positioning of the container body and the die members during the flanging operation.

FIGS. 2 through 7 illustrate sequentially the operations employed in forming a necked and flanged can body according to the method and apparatus of the present invention. In FIG. 2, a can body 1 includes a base region 5 and an open edge region 3. The can body 1 is positioned against a support member 7, such as a vacuum pad or, in the case of a steel can, a magnetic pad, which firmly holds the can body 1 thereagainst. Vacuum pad 7 may be, for example, a portion of a star wheel member, as is conventionally employed in the art to rotate can bodies from station to station within an apparatus for performing operations on a can body. In this case, vacumm pad 7 has been positioned to a necking and flanging station.

A stationary die 10 forms a portion of the necking and flanging station. The stationary die 10 includes a working surface 13 which corresponds to the desired profile for the edge region 3 of the can body 1 and an entrance bevel 15 at the entry point for the can body 1 into die 10. An inner die 12 is positioned adjacent outer stationary die 10. Inner die 12 has a working face of 14 which complements working face 13 of stationary die 10, such that the spacing between die elements 10 and 12 corresponds to the final desired configuration for the edge region 3 of the can body 1. The spacing between die members 10 and 12 is sufficient to enable the edge portion 3 of can body 1 to be positioned between surfaces 13 and 14 without ironing thereof. One or more inner die elements 12 may be positioned within stationary die 10. The dies 12 are mounted for driven rotation within die 10 about the axis of die 10.

In FIG. 3, can body 1 has been advanced by the vacuum pad 7 and the edge region 3 thereof is now positioned between outer stationary die 10 and the rotating inner dies 12. As the inner surface of the can body 1 contacts rotating dies 12, dies 12 rotate about their axis, in the direction opposite to the direction of their rotation about the axis of stationary die 10. Each inner die 12 is free-wheeling about its axis, typically being mounted within a bearing (not shown).

As the can body 1 is advanced by pad 7, the action of the die members 10 and 12 shape the edge region 3 of the can body 1 to the desired necked configuration. As illustrated, the configuration is that of the diameter corresponding to that of a triple-necked can body, but having only a single shoulder thereto.

In FIG. 4, the necking operation has been completed. To enable the now necked can body 1 to be removed from the dies 10 and 12, provision must be made for space to accomplish this result. Thus, inner dies 12 are mounted to be moved radially inwardly toward the axis of outer die 10 a sufficient distance to allow clearance between the smallest diameter of the now necked can body 1 between die surfaces 13 and 14.

In FIG. 5, it can be seen that the necked end region 3 of the can body 1 has been successfully removed from between dies 10 and 12 by means of the vacuum pad 7. At this point, die 12 could be moved radially outwardly to accept the next can body, again stepping through the operations of FIGS. 2 through 5. In such a case, the now necked can body 1 would be sent to a flanging station.

However, provision may be made for flanging the can body 1 at the necking station previously described. In FIG. 6, inner die 12 has been moved radially outwardly back to its original position as in FIGS. 2 and 3. Vacuum pad 7 again advances can body 1 toward the dies 10 and 12. This time, however, the now necked region 3 of the can body 1 contacts flanging surface 16 at the nose end of the still rotating inner die members 12. As can be seen in FIG. 7, the can body 1 is advanced until a flange 9 is formed thereon by flanging surface 16. At this point, the can body 1 is retracted and the star wheel is advanced to bring the next vacuum pad 7 and can body 1 in place to repeat the cycle.

As previously mentioned, a single inner die member 12 may be positioned within outer stationary die 10. However, it is preferred that more than one die member 12 be employed, and, it is highly preferable that at least three such die members 12 be employed, to provide relatively balanced forces on various portions of the can body 1.

The means for rotating die members 12 within stationary die 10 and for moving the die members 12 radially, inwardly and outwardly are conventional. Thus, the free-wheeling die members 12 may be mounted within bearings, with the bearings in turn being mounted on a shaft for rotation, with cam means being provided to move the die members 12 radially.

When employing the method and apparatus of the present invention, the die members 10 and 12 may have working surfaces to produce necking to single, double or triple necking sizes, all with a single shoulder thereon. Further, an increase in metal thickness in the edge region 3 may not be required, even when necking to triple neck diameters is accomplished by the method and apparatus of the present invention.

From the foregoing, it is clear that the present invention provides an effective one-step necking operation for can bodies which may provide time and machinery part savings from the conventional threestage triple necking operation. Since the metal of the edge region 3 of the can body is worked only once, reduced levels of pin holes and/or cracks may be expected.

While the present invention has been described with reference to certain specific embodiments thereof, it is not intended to be so limited thereby, except as set forth in the accompanying claims.

We claim:

1. Apparatus for necking and flanging a metallic can body comprising a stationary outer die member and a rotatable inner die member, said outer die member having a working surface corresponding to the desired necked configuration for said can body, said inner die member having a working surface corresponding to the desired necked configuration for said can body and a flanging surface on a nose portion thereof, said inner die member being mounted for driven rotation about the axis of said outer die member, said inner die member being mounted for free-wheeling rotation about its axis and said inner die member being mounted for radial movement within said outer die member.

2. The apparatus of claim 1 wherein plural inner die members are employed.

3. The apparatus of claim 1 wherein said working surfaces of said inner and outer die members are configured to produce a necked region on said can body corresponding in diameter to a single necked can.

4. The apparatus of claim 2 wherein said working surfaces of said inner and outer die members are configured to produce a necked region on said can body corresponding in diameter to a single necked can.

5. The apparatus of claim 1 wherein said working surfaces of said inner and outer die members are configured to produce a necked region on said can body corresponding in diameter to a double necked can and wherein said necked region has a single shoulder thereon.

6. The apparatus of claim 2 wherein said working surfaces of said inner and outer die members are configured to produce a necked region on said can body corresponding in diameter to a double necked can and wherein said necked region has a single shoulder thereon.

7. The apparatus of claim 1 wherein said working surfaces of said inner and outer die members are configured to produce a necked region on said can body corresponding in diameter to a triple necked can and wherein said necked region has a single shoulder thereon.

8. The apparatus of claim 2 wherein said working surfaces of said inner and outer die members are configured to produce a necked region on said can body corresponding in diameter to a triple necked can and wherein said necked region has a single shoulder thereon.

9. A method for necking and flanging a metallic can body comprising positioning an edge portion of said can body between an outer die member and an inner die member, said inner and outer die members having working surfaces corresponding to the desired necked configuration for said edge portion of said can body, rotating said inner die member about the axis of said outer die member and in contact with the inner surface of said can body, thereby rotating said inner die member about its axis, moving said inner die member radially inwardly, removing said can body from said inner and outer die members, moving said inner die member radially outwardly to its starting position and positioning said edge portion of said can body against a nose portion of said inner die member after necking to thereby flange the necked edge portion of said can body.

10. The method of claim 9 wherein plural inner die members are employed.

* * * * *